United States Patent [19]

Murakami et al.

[11] 4,391,702

[45] Jul. 5, 1983

[54] METHOD FOR CLASSIFICATION OF COALS FOR COKE PRODUCTION

[75] Inventors: Shozo Murakami; Hiroaki Yamanaka; Kazuhiro Yokoyama; Yasuhiro Yone, all of Himeji; Tokuji Yamaguchi, Kitakyushu, all of Japan

[73] Assignee: Nippon Steel Corporation, Tokyo, Japan

[21] Appl. No.: 309,406

[22] Filed: Oct. 7, 1981

Related U.S. Application Data

[63] Continuation-in-part of Ser. No. 73,320, Sep. 7, 1979, Pat. No. 4,310,412.

[30] Foreign Application Priority Data

Sep. 17, 1981 [JP] Japan ..... 56-146735

[51] Int. Cl.[3] ..... B07B 1/26

[52] U.S. Cl. ..... 209/10; 209/12; 209/270; 209/301; 209/380

[58] Field of Search ..... 209/10, 12, 30, 32, 209/268, 238, 301, 303, 304, 380, 250, 270; 210/403, 391, 409–412, 393

[56] References Cited

U.S. PATENT DOCUMENTS

| | | | |
|---|---|---|---|
| 1,675,621 | 7/1928 | Laird | 209/380 X |
| 1,877,157 | 9/1932 | Cannon | 210/409 |
| 2,491,877 | 12/1949 | Schug | 209/250 |
| 2,785,802 | 3/1957 | Symons | 209/301 X |
| 2,807,367 | 9/1957 | Symons | 209/301 |
| 2,956,347 | 10/1960 | Gordon | 209/10 X |
| 3,247,965 | 4/1966 | Braun et al. | 209/380 X |
| 3,737,032 | 6/1973 | Burkitt | 209/10 |
| 3,794,166 | 2/1974 | Converse et al. | 209/301 |
| 4,107,028 | 8/1978 | Emmett, Jr. et al. | 209/10 X |
| 4,310,412 | 1/1982 | Murakami et al. | 209/10 |

FOREIGN PATENT DOCUMENTS

| | | | |
|---|---|---|---|
| 944000 | 6/1956 | Fed. Rep. of Germany | 209/301 |
| 1806943 | 8/1969 | Fed. Rep. of Germany | 209/11 |
| 48-29601 | 9/1973 | Japan . | |

*Primary Examiner*—Richard L. Chiesa

*Attorney, Agent, or Firm*—Cushman, Darby & Cushman

[57] ABSTRACT

A method for classifying wet coal for obtaining coal charges suitable for use in a coke oven comprising classifying the wet coal directly in a cylindrical screen which rotates and revolves around an eccentric rotation shaft while blowing a high pressure gas stream to the screen to eliminate adhesion of the wet coal particles to the screen. The method enables a continuous and consistent classification of wet coals without the clogging of the screen and the dust pollution. The cokes obtained by dry distillation of the coal classified by the present method show high quality.

2 Claims, 5 Drawing Figures

METHOD FOR CLASSIFICATION OF COALS FOR COKE PRODUCTION

CROSS REFERENCE TO RELATED APPLICATION

This application is a continuation-in-part of our copending application Ser. No. 73,320 filed Sept. 7, 1979, now U.S. Pat. No. 4,310,412.

BACKGROUND OF THE INVENTION

1. Field of the Invention

The present invention relates to classification of wet coals for production of high-quality coke suitable for use in a blast furnace.

2. Description of the Prior Art

Conventionally, for production of coke for a blast furnace, the material coals (strongly coking coal and weakly coking coal) are mixed to obtain a mixture which is crushed and mixed and then charged into a coke oven for dry distillation.

However, in recent years it has been increasingly difficult to secure ample amounts of the strongly coking coal and various technical developments have been made for the purpose for expanding the applicability of various grades of coals, among which a classification-selective crushing method is well known.

Coals have different degrees of grindability depending on their constituents. Therefore, if they are crushed all together as conventionally done, relatively larger proportions of hard components, such as hard coal and durain having a lower coking property are likely to be distributed in the resultant larger particles and these hard components form the nucleus of cracking in the coke during dry distillation, thus resulting in brittle cokes. Meanwhile, the soft components, such as vitrain and clarain, are crushed unnecessarily.

Therefore, if coal particles rich in durain components which are hard to be crushed are selectively and repeatedly crushed and mixed together appropriately, it is possible to obtain uniform coal charges and the resultant cokes are improved in their quality, thus making possible to decrease the proportion of strongly coking coals to be mixed in the charge.

However, for classification and selective crushing of the material coals, it is necessary to classify the coals first. In this case, when the material coals contain 6% or less moisture, they can be classified by an ordinary vibration screen, but when their moisture contents are more than about 6%, they cannot be satisfactorily classified because they adhere and close the screen meshes. This is the reason why it has been rarely practised to classify and selectively crush the wet coals directly without pretreatments. As pretreatments for enabling the classification, various methods have been proposed, and for example, as disclosed in the Japanese Patent Publication No. Sho 48-29601, a method is known, in which a coal drying machine is provided for drying the coals to a moisture content ranging from 4 to 6% in advance to the screen device or a method is known, in which an electrically heated screen device is used.

However, all of the above conventional arts have disadvantages that a large capacity of the drying equipment is required for drying a large amount of the material coals to a moisture content less than 6%, that a large amount of energy is consumed, or that a short-time drying and careful considerations against public pollution are required, and these conventional arts have been confronted with by a problem that if the moisture content of material coals cannot be uniformly lowered, the classification efficiency will be critically lowered.

The present inventors have made search for a classifier which can satisfactorily classify the wet coals, but found that none of the conventional classifiers can classify the wet coals directly.

Then the present inventors have made various extensive experiments on applicability of a rotary type of classifier to classification of wet coals. This type of classifier shows a good classification efficiency and is of a compact size and almost free from dust generation. The results of the experiments have revealed that the classification of wet coals can be continuously and satisfactorily performed if a high-pressure gas is blown to the screen meshes under specific conditions.

The material coals for coke production which are available in Japan usually contain more than 6% moisture, depending on their origins, and their particle size distribution is that −3 mm mesh particle ranges from 30 to 80%.

According to the results of our experiments, the adhesion to the screen meshes of the above type of material coals differ depending on the moisture contents and the proportions of the fine particles. For example, when the proportion of the fine particles is constant, the adhesion to the screen meshes increases as the moisture content is raised, showing a peak at a moisture content from 11 to 12%, and thereafter, lowers and when the moisture content exceeds 14%, the classification becomes possible, but this level of moisture content is undesirable for charging in the coke oven. For charges in the coke oven, a lower moisture content is more desirable.

SUMMARY OF THE INVENTION

Therefore, one of the objects of the present invention is to provide a method for classifying wet coals using a rotary type of classifier to obtain charges suitable for charging in a coke oven for production of cokes suitable for use in a blast furnace.

According to the present invention, a single grade of wet coal or a mixture of wet coals of different grades is supplied into a cylindrical screen from its open top, and classified therein while the cylindrical screen is rotated and revolved almost in a vertical position, and while the cylindrical screen is rotated and revolved the screen is cleaned by a specific means, and wet coal adhering on the inner surface of the casing is removed by a specific method.

DETAILED DESCRIPTION OF THE INVENTION

The present invention will be described in detail referring to the attached drawings.

Figure 1A:
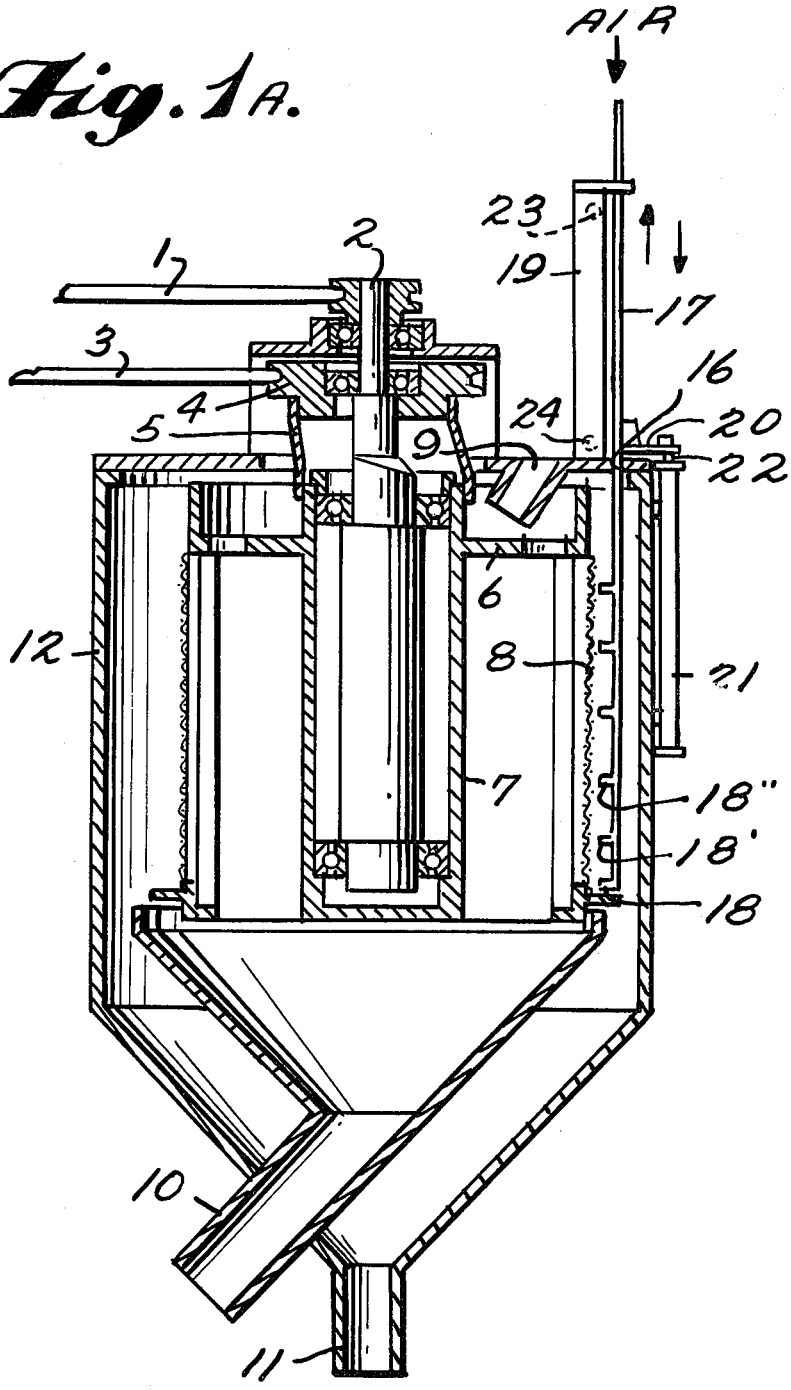
FIG. 1(A) shows a cross-sectional view of a rotary type classifier used in the present invention.

In FIG. 1(A), when a vertical rotation shaft 2 is rotated by the driving force from a belt 1 and at the same time a pulley 4 is rotated around the rotation shaft 2 by the driving force from a belt 3, a screen device comprising a flexible joint 5, a supply plate 6, a sleeve 7 and a cylindrical screen 8 is revolved around the center of the eccentric rotation shaft 2, which device is rotated at a faster rotation speed than that of the rotation shaft 2, so that the cylindrical screen 8 is subjected to vibration due to the combination of its rotation and revolution around the eccentric rotation shaft 2 (eccentricity: 5–10 mm, and vibration amplitude of the screen: 10–20 mm).

Figure 1B:
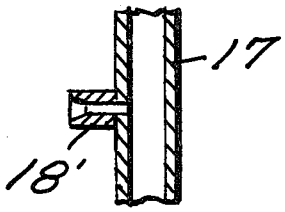
FIG. 1(B) shows a nozzle for blowing a high pressure gas against the screen meshes.

When the wet coal to be classified is supplied from the supply opening 9, while the screen device is rotated (40–150 rpm) and revolved as above, it is subjected to the centrifugal force (3–5 G), the vibrating force and the gravity, so that the material repeatedly collides against the inside wall of the screen and is repelled back thereby and falls down, during which the material particles smaller than the sleeve mesh pass through the screen, in this way, the material is classified. The classified materials, over-mesh and under-mesh, are discharged from the conduits 10 and 11 respectively. The upper face of the casing 12 is provided with an opening 16 through which a supply pipe 17 for supplying a compressed air is inserted. Along the whole length of the supply pipe 17, a plurality of air blowing nozzles 18, 18′, 18″. . . are spacedly attached to the pipe with their top ends being directed to the outer side of the cylindrical screen 8. The nozzles are shown more specifically in FIG. 1(B). These nozzles function to jet fluxes of the air supplied from a compressed air supplying source (not shown) under a predetermined pressure. The number of the nozzles are not critical, and may be selected according to the necessity.

The upper portion of the supply pipe 17 protrudes from the casing 12 and is slidably supported by a guide member 19 mounted on the upper side of the casing 12. Also an arm 20 is fixed to the protruding upper portion of the supply pipe 17 and is connected to a piston rod 22 of a hydraulic cylinder 21 fixed to the side of the casing 12. When the cylinder 21 is actuated the supply pipe 17 moves up and down and hence the nozzles 18, 18′, 18″ . . . move up and down parallel to the outer side of the cylindrical screen 8. The movement of these nozzles is limited between an upper limit and a lower limit by controlling the operation range of the cylinder 21 by means of limit switches 23 and 24 provided on the guide member 19. The control of the vertical movement of the supply pipe 17 may be done by other conventional devices, such as by a conventional driving mechanisms.

Regarding the position at which the supply pipe 17 is placed in the peripheral direction of the screen device, the position below the material supplying opening 9 is more preferable. With this arrangement, the screen meshes are cleaned more effectively before the material coal is introduced in the cylindrical screen.

The material coal supplied from the supply opening 9 is brought into contact mainly with the upper portion of the screen, and for this reason, it is desirable to arrange the nozzles on the supply pipe with decreasing pitches toward the upper portion of the supply pipe. The compressed air supply pipe 17 may be provided in any desired number.

When the classification of the coal is effected without the above cleaning of the screen meshes by means of the compressed air, it is impossible to avoid the clogging of the screen meshes by the wet coal particles even when the cylindrical screen 8 rotates and vibrates.

Figure 2:
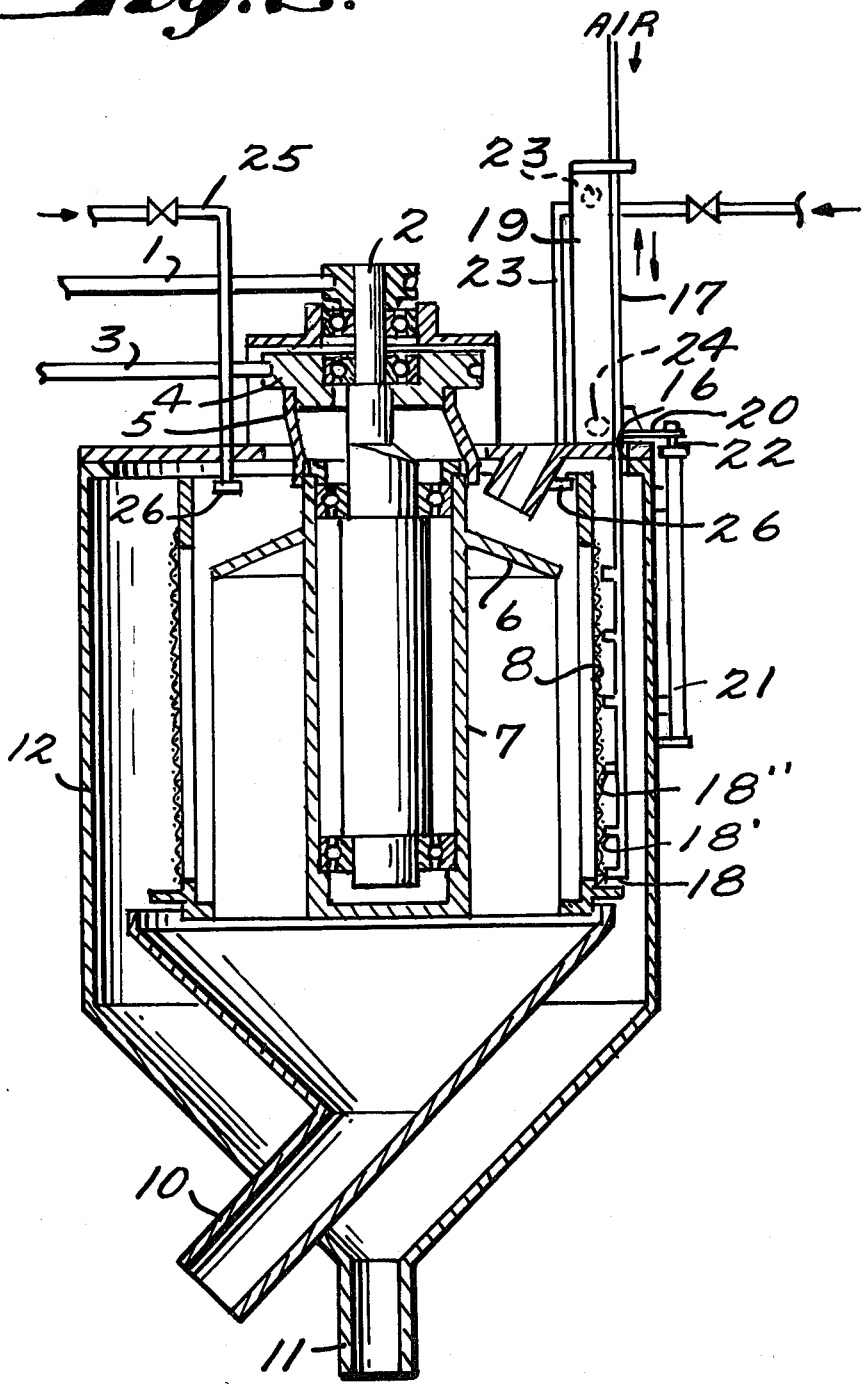
FIG. 2 shows a modification of the classifier shown in FIG. 1(A).

In FIG. 2, 25 represents water supply pipe, having a nozzle 26 at its end, positioning above the supply plate 6. In event wet coal particles adhere to the inner surface of the casing 12, water is supplied from the nozzle 26 to the vacant rotating cylindrical screen 8 without wet coal material therein before the device becomes inoperative due to the adhesion. The water is thrown to the casing through the network of the screen by the rotation of the screen so that the adhesion can be effectively removed.

Figure 3:
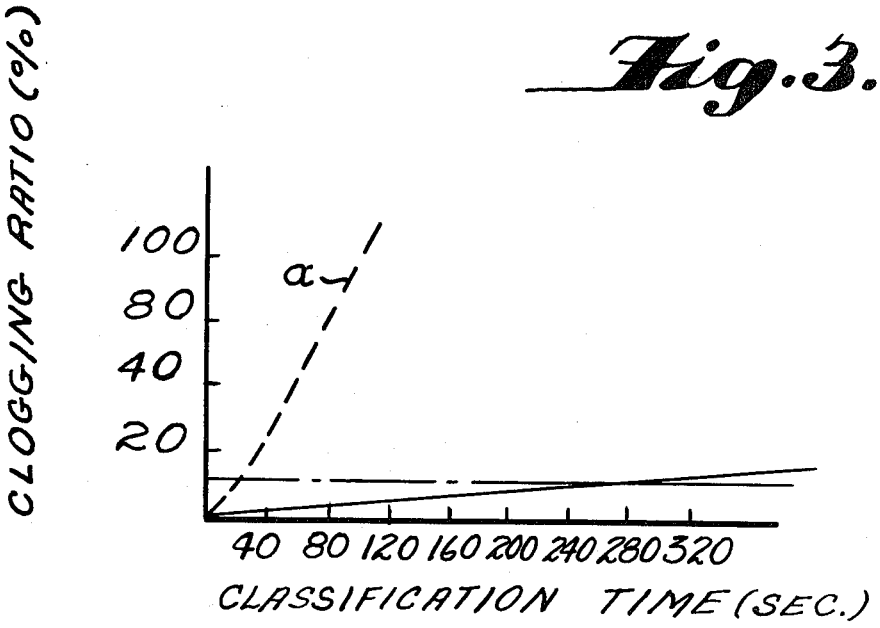
FIG. 3 is a graph showing the relation between the clogging of the screen meshes and the classification time.

In FIG. 3, there is shown how the classification efficiency is lowered by the adhesion of the coal particles to the screen depending on the moisture contents of the wet material coal and the proportion of fine particles. In this case, a cylindrical screen of 3 mm mesh is used and "a" in the figure represents the material coal containing 12% moisture with the −3 mm mesh particle proportion of 78%, and "b" represents the coal containing 7% moisture with the −3 mm mesh particle proportion of 54%. The coal represented by "a" belongs to a grade which more easily adheres to the mesh among the coals used in Japan, and this coal "a" begins to show the lowering of classification efficiency in about 20 seconds after the classification is started in the cylindrical screen described above.

While the coal "b" which has less tendency to adhere to the screen begins to show the lowering of classification efficiency in 5 minutes.

In order to prevent the clogging of the screen meshes by the wet coal particles, it may be considered to give the particles a centrifugal force stronger than their adhesions, but this has been found not to be satisfactorily effective, and it causes difficulties in the mechanical structure.

When the air supply pipe is fixedly provided in the vertical direction of the rotary cylindrical screen and a number of the high-pressure gas jet nozzles are provided on the fixed supply pipe, it will be necessary to use side angle nozzles in order to cover the dead spaces between the nozzles, but in this case, satisfactory cleaning of the screen cannot be obtained when the gas velocity lowers, and a larger amount of gas to be jetted is required. Therefore, the inside pressure in the casing of a given capacity is increased, so that fine coal particles are blown back out of the material supply opening and blown into the opening for discharging the classified coal particles, thus causing the problem of dust pollution.

According to the present invention, the compressed air supply pipe 17 having the nozzles, provided opposing to the outer side of the cylindrical screen is moved up and down, so as to move the high-pressure gas fluxes up and down while they are blown, so that the wet coal particles adhering to the screen meshes are effectively blown off and hence consistent and effective classification of wet coal can be achieved.

In this case, when the cleaning of cylindrical screen meshes is done with water jet, this means addition of water to the coal being classified, thus causing lowered productivity of a coke oven due to the heat balance.

According to the present invention, gas, such as air, is used for the cleaning agent, and since the gas jet has no ability to change the adhesion of the wet coal particles to the screen meshes, it can blow off the coal particles instantaneously by its physical jet force. Further, according to the present invention, as the compressed air nozzles are moved up and down it is possible to apply strong gas fluxes to the screen and at the same time, it is possible to reduce the number of nozzles considerably, thus overcoming the disadvantages caused when the nozzles are fixedly arranged.

The minimum frequence of gas streams to be applied to the screen required for satisfactory classification in the present invention may be illustrated below. In case of the examples shown in FIG. 3, supposing 10% mesh clogging is the upper limit for a satisfactory and consistent classification, the gas jet streams have to be blown only once every 20 seconds even in the case of the coal "a" containing a larger water content, and they have to be blown only once every 5 minutes in the case of the coal "b" containing a lower water content and thus less adhering.

In the practical operation, the nozzles may be continuously or intermittently moved up and down. Although the number of the nozzles is not critical in the present invention, when the nozzles cannot be moved up and down in a predetermined time due to the relation between the height of the cylindrical screen and its rotation speed, two or more supply pipes 17 may be provided and moved up and down alternately.

Through the above described operation, the wet coal is directly classified and the fraction of the coal which does not pass the screen and is discharged from the inside of the cylindrical screen is usually crushed by an ordinary crusher. And this crushed material is again classified by the classifier means so as to enable selective crushing.

Figure 4:
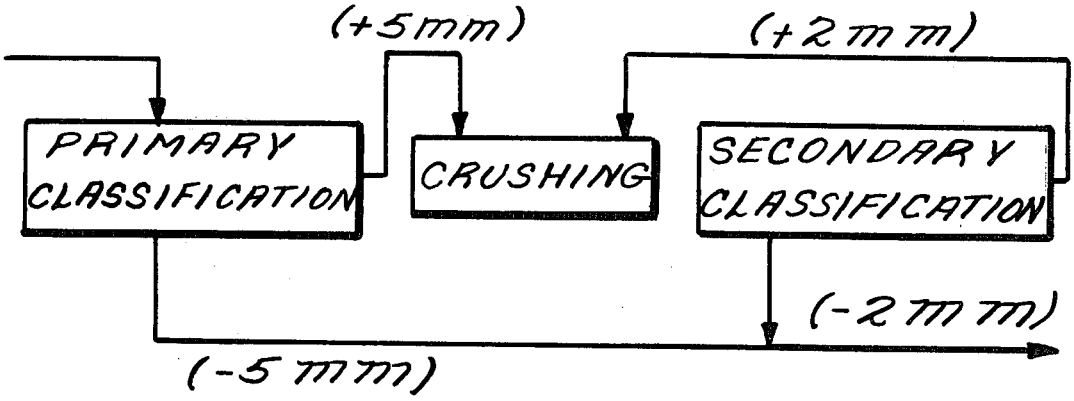
FIG. 4 shows one embodiment of the classification-selective crushing process according to the present invention.

For the selective crushing, the primary classification is done by a 5 mm mesh screen, for example, the resultant +5 fraction is crushed and subjected to the secondary classification using a 2 mm mesh screen, and the resultant +2 fraction is crushed as schematically shown in FIG. 4.

Both the fractions obtained by the primary classification and the secondary classification are mixed together and charged in a coke oven, where the coal particles rich in the durain component are selectively crushed and are uniformly dispersed to give coal charges having an excellent coking property, and hence the resultant coke after dry distillation shows a markedly improved quality.

Also, the process shown in FIG. 4 may be arranged in a double way and in one process the coal rich in the vitrain and clarain components is subjected to a primary classification using a 7 mm mesh screen, for example, and the resultant over-mesh fraction is subjected to soft grinding followed by a secondary classification using a 5 mm mesh screen and grinding. By repeating the classfication and grinding the coal is adjusted into somewhat large particles. In the other process, the coal rich in the durain component is subjected to a primary classification using a 5 mm mesh screen and the resultant over-mesh fraction is subjected to grinding followed by a secondary classification using a 2 mm mesh screen. By repeating the above treatments, the coal rich in the durain component can be finely crushed. Then the large-particle coal and the finely crushed coal are mixed together at a predetermined proportion. In this way, charges having excellent coking and coking properties as well as a high density can be obtained.

When these charges are subjected to dry distillation in a coke oven, a high-quality of coke and a high degree of productivity can be assured. Also a high efficiency in the classification-selective crushing step can be assured.

EXAMPLE 1

The coal containing 3 mm or larger particles in an amount of 30% and less than 3 mm particles in an amount of 70% and 10% total moisture content was directly supplied into a rotating cylindrical screen, as shown in FIG. 1 from the upper portion. The cylindrical screen was 1.2 m in height, and of 3 mm mesh. The whole coal material was subjected to repeated classification and crushing by means of the classifier as shown in FIG. 1 and a repellent type crusher to obtain particles of 3 mm or less. During the classification air fluxes under a pressure of 55 kg/cm$^2$ were blown to the outer side of the cylindrical screen from a compressed air supply pipe having eight nozzles of 3.2 mm aperture arranged on the pipe with 150 mm pitch therebetween. These air fluxes were moved continuously up and down in the direction of the screen height at a speed of 20 seconds for one reciprocating movement.

During four continuous operation at a treating capacity of 100 t/hr, the classifier was stoppd twice, namely one hour after the start of the operation and three hours after the start of the operation, to see the condition of the cylindrical screen, but no clogging of the meshes impairing the classification was observed.

Whereas, when the air was continuously blown under a pressure of 4.9 kg/cm$^2$ at a velocity of 25 m$^3$/min. by using a stationary compressed air supply pipe having plural nozzles of 3 mm diameter arranged with 15 mm pitch therebetween, clogging of the screen meshes was observed about 30 minutes after the start of the operation, and no further classification was possible.

The coke obtained by dry distillation of the coal having 3 mm or less particle size obtained by the classification according to the present invention showed strength of $DI_{15}^{150}$ 82%.

Meanwhile, the coke obtained by dry distillation of the same coal containing 85%, 3 mm or less particles without classification showed a strength of $DI_{15}^{150}$ 80%.

EXAMPLE 2

A blend of coals containing 3 mm or larger particles in an amount of 45%, particles less than 3 mm in an amount of 55% and a total moisture content of about 7% was supplied into a rotating cylindrical screen of 5 mm mesh, as shown in FIG. 1, and subjected to classification for one hour while air fluxes under a supply pressure of 6 kg/cm$^2$ were blown to the outer side of the rotating screen intermittently by using a compressed air supply pipe having eight nozzles of 3.2 mm aperture diameter arranged with 150 mm pitch therebetween which was reciprocated in the direction of the screen height once every five minutes. During the operation, no clogging of the screen meshes was observed.

Meanwhile, a blend of coals containing 30% of particles, 3 mm or larger, 70% of particles less than 3 mm and about 13% of a total moisture was directly supplied to another rotating cylindrical screen of 3 mm mesh and the air fluxes were blown under the same conditions just abovementioned to effect the classification for one hour to obtain the coal of 3 mm or less particles. During this operation, no clogging of the screen mesh was observed.

The resultant mixture coke (50:50) showed a strength of $DI_{15}^{150}$ 84.5%.

For comparison, the same blend of coals was crushed so as to obtain 85% of −3 mm mesh particles without the classification and subjected to dry distillation. The resultant coke showed a strength of $DI_{15}^{150}$ 83%.

If the classification according to the present invention is performed in such a mode to assure the strength of $DI_{15}^{150}$ 83%, it is possible to save the strongly coking coal by about 10%.

Meanwhile, when the stationary compressed air supply pipe was used as referred to as comparison in Example 1, the clogging of the screen meshes was observed about 45 minutes after the start of the operation in the case of the 5 mm or less particle material and about 20 minutes after the start of the operation in the case of the 3 mm or less particle material, and further classification was impossible.

EXAMPLE 3

The classifier shown in FIG. 2 was used, and a blend of coals containing 3 mm or larger particles in an amount of 30%, particles less than 3 mm in an amount of 70% and a total moisture content of about 10% was supplied from the upper portion of the rotating cylindrical screen of 1.2 m in height and of 3 mm mesh as shown in FIG. 2, and subjected to classification by air fluxes under a pressure of 5.5 kg/cm$^2$ jetted from a compressed-air supply pipe having eight nozzles of 3.2 mm aperture diameter with 150 mm pitch therebetween toward the outer side of the cylindrical screen. The air fluxes were continuously moved up and down along the screen height once every 20 seconds.

During 4 hour continuous operation with a capacity of 100 tons per hour, the operation was stopped twice: one hour and three hours after the start of the operation to observe the condition of the cylindrical screen and no clogging of the screen which hindered the classification was observed.

At the end of treatment of 2,000 tons of the blend in this way a large amount of wet coal particles adhered to the casing so that the screening operation was hindered.

Then, the operation was performed under the conditions as below:

1. Operational condition of the cylindrical screen Rotation: 55 r.p.m.
2. Supply condition of washing water 22.5/minute at four places
3. Washing time: 3 minutes In this way, the adherence was completely eliminated.

The above examples are for the purpose of illustrating the present invention for the ordinary coke production process, but the present invention should not be limited by the types of coke production process, but can be applied to various coke production processes such as form coke process, preheating process, briquette blend coking process and so on.

What is claimed is:

1. A method for classifying wet coal for coke production comprising:

supplying the wet coal into a cylindrical screen arranged in a casing, rotating and revolving the screen in an almost vertical position to subject the wet coal to gravity, centrifugal force and vibrating force, blowing a high pressure gas stream against the outer side of the screen, and vertically moving the blowing position of the gas stream to clean the screen, while classification is being performed so as to obtain the under-mesh and over-mesh coal fractions, and removing adhesions on the inner surface of the casing by the force of water supplied to the rotating screen and thrown thereby from the outside of the screen after the supply of wet coal is stopped.

2. A method according to claim 1 in which the adhesions on the inner surface of the casing are removed by dispersing washing water in a radial direction from a nozzle arranged above a supply plate provided within and rotatable with the cylindrical screen by the rotation of the supply plate.

* * * * *